US007421766B2

(12) United States Patent
Münstermann

(10) Patent No.: US 7,421,766 B2
(45) Date of Patent: Sep. 9, 2008

(54) DRUM FOR FORMING RELIEF PATTERNS ON A TEXTILE WEB

(75) Inventor: Ullrich Münstermann, Egelsbach (DE)

(73) Assignee: Fleissner GmbH, Egelsbach (DE)

( * ) Notice: Subject to any disclaimer, the term of this patent is extended or adjusted under 35 U.S.C. 154(b) by 0 days.

(21) Appl. No.: 11/706,567

(22) Filed: Feb. 15, 2007

(65) Prior Publication Data

US 2007/0261541 A1 Nov. 15, 2007

(30) Foreign Application Priority Data

Feb. 17, 2006 (DE) ..... 10 2006 007 834

(51) Int. Cl.
*D04H 5/02* (2006.01)

(52) U.S. Cl. ..... 28/167; 28/104

(58) Field of Classification Search ..... 28/104, 28/105, 106, 167; 492/28, 30, 49, 31–37; 162/289, 296, 297, 310, 348, 351, 357
See application file for complete search history.

(56) References Cited

U.S. PATENT DOCUMENTS

| | | | | |
|---|---|---|---|---|
| 3,330,009 | A * | 7/1967 | Hynek | 28/105 |
| 3,679,536 | A * | 7/1972 | Kalwaites | 428/131 |
| 3,681,184 | A * | 8/1972 | Kalwaites | 428/134 |
| 3,750,237 | A * | 8/1973 | Kalwaites | 28/105 |
| 3,787,932 | A * | 1/1974 | Kalwaites | 28/105 |
| 4,868,958 | A * | 9/1989 | Suzuki et al. | 28/104 |
| 5,098,764 | A * | 3/1992 | Drelich et al. | 428/131 |
| 5,585,017 | A | 12/1996 | James | 219/121.71 |
| 5,822,833 | A * | 10/1998 | James et al. | 28/105 |
| 5,906,786 | A | 5/1999 | James | 264/400 |
| 6,024,553 | A | 2/2000 | Schimalla | 425/290 |
| 6,324,738 | B1 | 12/2001 | Fleissner | 28/104 |
| 6,708,381 | B2 * | 3/2004 | Strandqvist et al. | 28/104 |
| 6,725,512 | B2 * | 4/2004 | Carter | 28/104 |
| 2002/0002764 | A1 * | 1/2002 | Putnam et al. | 28/104 |
| 2002/0004348 | A1 | 1/2002 | Kelly | 442/327 |
| 2002/0034914 | A1 * | 3/2002 | De Leon et al. | 442/384 |
| 2002/0132714 | A1 | 9/2002 | Carter | 492/28 |
| 2003/0019088 | A1 * | 1/2003 | Carter | 28/104 |
| 2003/0088956 | A1 | 5/2003 | Strandqvist | 28/104 |

FOREIGN PATENT DOCUMENTS

| | | | |
|---|---|---|---|
| WO | WO-9722434 | | 6/1997 |
| WO | WO-2006041191 | | 5/2006 |
| WO | WO 2006/123063 | A2 * | 11/2006 |
| WO | WO-2006123063 | | 11/2006 |

* cited by examiner

*Primary Examiner*—Amy B Vanatta
(74) *Attorney, Agent, or Firm*—Andrew Wilford

(57) ABSTRACT

A drum for forming relief patterns on a surface of a textile web has a tubular jacket rotatable about an axis and having a substantially cylindrical outer surface centered on the axis and formed with an array of raised portions separated by lands and with a multiplicity of radially throughgoing holes. The holes are elongated and extend at angles between 20° and 170° to midplanes extending perpendicular to the axis, the web engaging the drum. Liquid jets are directed radially inward at the web where it engages the drum for impressing the raised portions into a face of the web. Liquid is aspirated inward through the holes from the web where it engages the drum.

18 Claims, 3 Drawing Sheets

DRUM FOR FORMING RELIEF PATTERNS ON A TEXTILE WEB

FIELD OF THE INVENTION

The invention relates to a drum jacket for forming structures and/or relief patterns on a surface of a woven or nonwoven cellular material, fleece and/or woven or knitted textile by means of raised formations or structure elements on the drum jacket and a plurality of holes provided on the surface of the drum jacket for dewatering the drum jacket.

BACKGROUND OF THE INVENTION

WO 2005/124001 describes a drum jacket for the creation of structures and relief patterns on the surface of a woven fleece by means of structure elements arranged in serpentines on a drum jacket having a plurality of holes arranged at random on the surface and in the depressions between the structure elements. Thus, the dewatering is insufficient, especially as far as the lower areas or the depressions are concerned, even more so since the holes are not oriented exclusively outward, that is radially of the drum jacket. A further disadvantage consists in the fact that the diameter of the holes is circular, so that a high number of circular holes are required in order to achieve a good dewatering effect. Due to the circular holes, undesired bumps are formed on the surface. Moreover, areas become unequal in their weight. As far as the arrangement of the holes is concerned, no preferred dewatering can be achieved; consequently, the dewatering is insufficient, particularly in the lower areas, since the holes are evenly spread over the whole surface.

OBJECT OF THE INVENTION

It is an object of the invention to provide drum jackets, particularly surface-relief drum jackets for generating relief patterns on webs of fabrics or on nonwoven or woven fibers, i.e. a fleece, consisting of short but also of endless fibers such as synthetic staple fibers or also natural fibers, in such a manner that a perfect dewatering of the drum jackets is ensured.

SUMMARY OF THE INVENTION

The invention is solved according to the invention by the following features:

a) one or more holes are provided, at least in the raised formations or structure elements and/or in the lands between the raised formations or structure elements, having an essentially elongated cross-sectional shape or made elongated.

b) the long sides of the holes or midplanes of the holes extend across a movement plane or midplane of the drum jacket at an angle β between 20° and 170° or between 40° and 160° or between 80° and 100°.

Thus, a significantly more effective and directed dewatering of the drum jacket can be done and in addition wash-out of the fleece, in particular of the relief patterns formed on the fleece is avoided. The additional holes provided in the depressions are particularly suitable for thin-walled drum jackets that so far have been hard to dewater, particularly in the case of fleeces with very thin fibers, thick fibers and also short cellulose fibers or pulps. By means of the advantageous formation of the drum jacket with the plurality of holes in the structure elements and in the depressions, dewatering is optimized in a simple manner. Thanks to the use of narrow, elongated holes, less imprints are left on the surface of the fleece. Dewatering should not lead to a structuring or marking of the fleece. By means of the inventive elongated holes a smooth surface on the fleece is realized. Due to the elongated holes, a very large open surface with a very good dewatering is achieved, without having to face the disadvantages associated with circular holes. Furthermore, the holes are exactly aligned relative to the movement plane of the drum jacket in order to ensure an optimal dewatering effect. The fibers of the fleece are very strongly aligned longitudinally or on the movement plane of the fleece; thus, they do not fall as easily into the diagonal holes as when circular holes or holes which are basically parallel to the movement plane of the drum jacket are provided.

To this end it is advantageous that the raised formations or structure elements and the lands between the raised formations and structure elements form lower areas in which at least one or more elongated holes are provided. For the purpose it is advantageous that the raised formations or structure elements forming the outer side of the drum jacket together with the lands situated therebetween form lower areas in which elongated holes are provided. The raised formations or structure elements corresponding to the outer side of the drum form the background area on the future visible side of the fleece material, while corresponding raised formations are formed by the lower, deeper areas.

Furthermore, it is advantageous that one or more elongated holes are either provided in the lands between the raised formations of structure elements or only in the raised formations and that the long sides of the longitudinal holes or the midplanes of the holes cross the movement plane or midplane of the drum jacket at the angle β between 20° and 170° or between 40° and 160° or between 80° and 100°.

Depending on the consistency of the material or of the fleece to be processed, a reduced number of holes may be provided for dewatering purposes.

It is also advantageous that the structure elements or raised formations provided on the drum jacket are designed as longitudinal raised formations arrayed over the whole circumference of the drum jacket angularly or approximately diagonally to the circumferential direction of the drum jacket over its whole length and either form continuous structure elements or raised formations or form raised formations which are interrupted at some points. If the longitudinal raised formations are not aligned exactly relative to the movement plane of the drum jacket, but at least slightly diagonally, washing of the filaments through the holes is advantageously avoided. The results can be positively influenced by an angle β of 170° between the transverse plane and the movement plane of the drum jacket being reduced toward 90°.

It is further advantageous that the structure elements or raised formations provided on the drum jacket are made as longitudinal raised formations arranged at a spacing from the ends of the drum jacket. By means of this, a very robust drum jacket suitable for extremely long use is obtained.

It is also advantageous that the structure elements or raised formations provided on the drum jacket are realized as solid bodies.

Furthermore, it is advantageous that the structure elements or raised formations are of cubic or pyramidal shape, the raised formations each having at least one longitudinal hole and the holes provided in the depressions representing about 12% to 80% or 40% to 50% of the total surface of the respective depressions. Depending on the application or processing of the fleece, the drum jackets are installed with the described holes in order to thus optimize the dewatering of the drum jacket.

It is also advantageous that the holes, at least in the raised formations and structure elements and/or in the lands are arranged approximately parallel to, or oriented in or diverging from the direction of the outer surface of the drum jacket.

It is also advantageous that the structure elements or raised formations with holes have different forms of profiles, the holes being limited by lateral elements of different dimensions and at least the biggest lateral element intersecting the movement plane or the midplane of the drum jacket at an angle β between 20° and 170° or between 40° and 160° or between 80° and 100°. The more the angle β is angled toward 90°, the less filaments pass through the holes.

In a further embodiment of the invention it is advantageous that the structure elements or raised formations have an approximately flat surface directed outward or toward the outer circumference and have different profiles in top view, the flat surface of the raised formation being approximately parallel or almost parallel to the surface of the drum jacket or one of the sieve sleeves of the drum jacket. A structure in the fleece is advantageously formed by the raised formations.

According to a preferred embodiment of the invention, the holes in the structure elements are provided with a width of between 0.1 and 1.0 mm or between 0.2 and 0.8 mm or 0.4 and 0.7 mm.

It is also advantageous that the holes in the depressions are provided at a width of between 0.2 and 1.0 mm or between 0.2 and 0.8 mm or between 0.3 and 0.7 mm or between 0.3 and 0.6 mm or between 0.4 and 0.7 mm or between 0.3 and 0.6 m or between 0.4 and 0.7 mm or between 0.5 and 0.7 mm, preferably 0.6 mm.

Moreover, it is advantageous that a lateral area of the structure elements forms an angle α of 90° together with a surface of the structure elements.

It is also advantageous that the lateral area of the structure elements forms an angle α with the surface of the structure elements of between 90° and 30° or 90° and 40° or 90° and 50° or 90° and 60°, particularly between 90° and 80°. Furthermore it is advantageous that the profile of the longitudinal holes in the depression and/or in the raised formation is oval or polygonal, particularly hexagonal, rectangular, or triangular.

Furthermore it is advantageous that the holes in the depressions are surrounded by rims of widths smaller than the length of the hole.

In a further development of the invention it is advantageous that the holes in the depressions are surrounded by rims of widths between 0.2 and 0.88 mm, preferably between 0.3 and 0.7 mm or between 0.4 and 0.6 mm.

It is further advantageous that one flank of each structured element is rounded, while the transition between the flank of the structure element and the surface of the depression is somewhat sharp-edged. Since the structure elements have tilted flanks and are rounded at the ends, a gentle treatment of the fleece is guaranteed. The sharp-edged transitions in the area of the depression guarantee the formation of well defined relief patterns.

According to a preferred embodiment of the inventive solution it is provided that the elongated holes are of a length of between 2 and 4 mm and of a width of between 0.4 and 0.6 mm.

BRIEF DESCRIPTION OF THE DRAWING

Further advantages and details of the invention are described in the claims and in the description and are illustrated in the figures.

SPECIFIC DESCRIPTION

Figure 1:
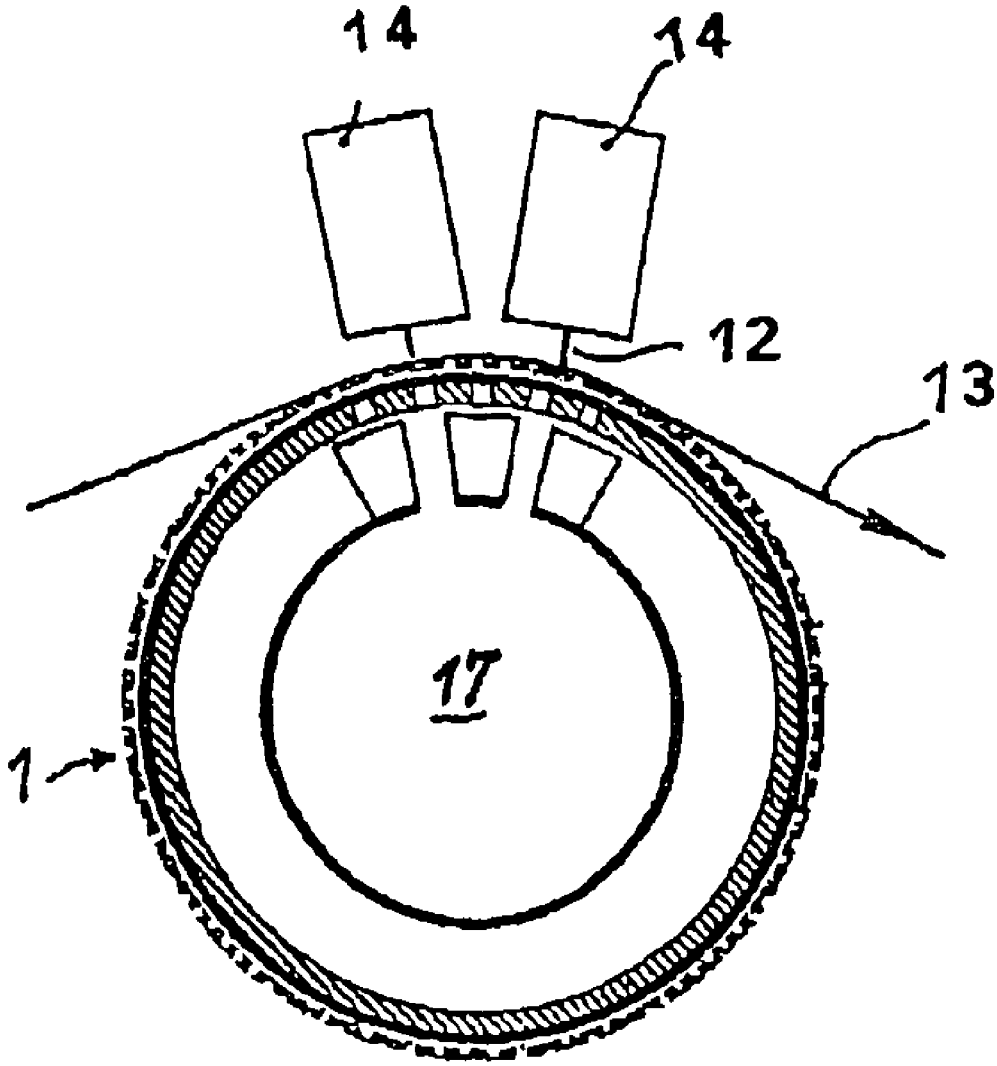
FIG. 1 shows a drum jacket for forming structures and/or relief patterns on the surface of a woven or nonwoven cellular material or fleece and/or woven goods and knitwear with a plurality of dewatering holes.
Figure 2:
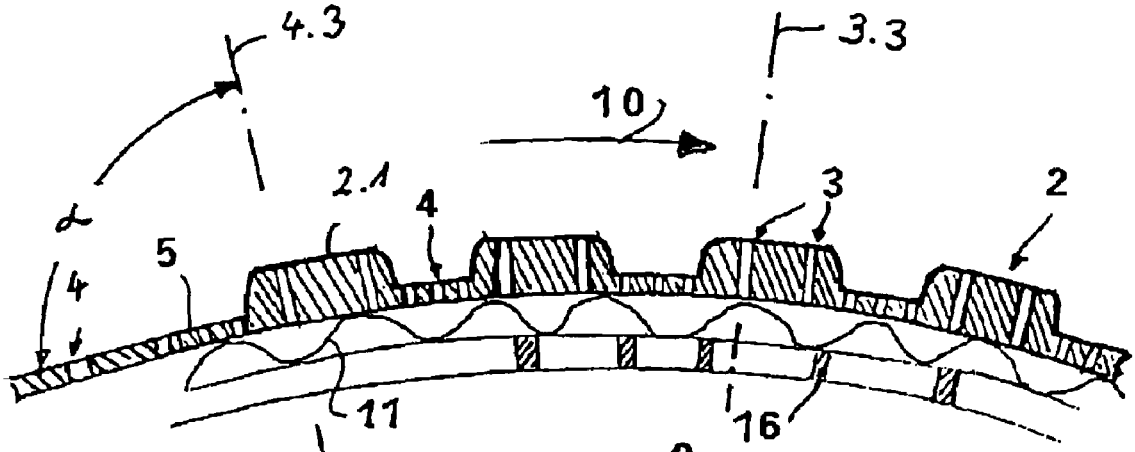
FIG. 2 shows a section through the drum jacket according to FIG. 1.

In FIGS. 1 and 2 a drum jacket 1 or a structure drum are shown consisting of a thin-walled sieve sleeve 1.1 on the surface of which a plurality of structure elements 2 are arranged at a uniform spacing from one another. In FIG. 2 only two holes 3 are provided in the structure elements 2. According to embodiment, however, more than two holes 3 or no holes at all can be provided in one of the structure elements 2.

According to the illustrated embodiment shown in FIG. 2, holes 3 and 4 can be provided in the raised formations or structure elements 2 and in the lands 5 between the raised formations or structure elements 2.

According to a further illustrated embodiment not shown in the drawing, the holes 4 may also be provided only in the lands 5 between the raised formations or structure elements 2.

A fleece 13 and/or woven or knitted textile to be patterned are guided over the drum jacket 1 that has a plurality of depressions 5. Nozzle beams 14 are arranged parallel to the axis of the drum jacket 1. The underside of each nozzle beam 14 has a nozzle strip, which is not shown in the drawing, by means of which water jets 12 are ejected. The water is drawn off by a suction tube 17 schematically indicated in the drawing. For this purpose, the holes 3 and 4 are provided in the raised formations or structure elements 2 and in the lands 5, as will be explained in detail in the following.

The holes 3 and/or 4 of the drum jacket 1 can be provided with differently shaped profiles of the same or of different sizes. Longitudinal sides or side elements 3.1 and 4.1 or midplanes 3.3 and 4.3 of the holes 3 and 4 intersect the movement plane or midplane 10 of the drum jacket 1 at an angle β between 20° and 170° or between 40° and 160° or between 80° and 100°.

The structure elements or raised formations provided on drum jacket 1 are realized as longitudinal structure elements or raised formations 2 arrayed over the whole surface of the drum jacket extending angularly or approximately diagonally to the rotation direction of the drum jacket over its whole length and form either continuous structure elements or individual raised formations and/or raised formations that are interrupted at some points. The raised formations are spaced from the ends of the drum jacket 1. Moreover, the structure elements or raised formations 2 provided on the drum jacket 1 can be made as solid bodies or also as hollow bodies according to a further embodiment that is not shown.

In the illustrated embodiment, the holes 3 and/or 4 are elongated, oval or polygonal, particularly hexagonal, rectangular or triangular and have the longitudinal side 4.1.

A good dewatering result is also obtained by the fact that the longitudinal sides 4.1 or the midplanes 4.3 of the holes extend diagonally to the movement plane. The movement plane 10 shown in FIG. 1 and indicated by an arrow corresponds to the cross-section plane of the drum jacket 1.

The angle β formed between the movement plane or the cross-section plane 10 of the drum jacket 1 and the longitudinal sides or the lateral elements 3.1 and 4.1 or the midplanes 3.3 and 4.3 of the holes 3 and/or 4 is between 20° and 170° or between 40° and 160° or between 80° and 100°.

The structure elements or raised formations 2 have approximately flat faces 2.1 directed radially outward and have different shapes in top view, the flat face 2.1 of the raised formation 2 being approximately parallel or almost parallel to the outer surface of the drum jacket 1 or of the sieve sleeve 1.1 of the drum jacket 1.

A coarse-mesh backing fabric 11 and a spun-lace cylinder 16 permeable to fluid may be provided inside the drum jacket 1.

Figure 3:
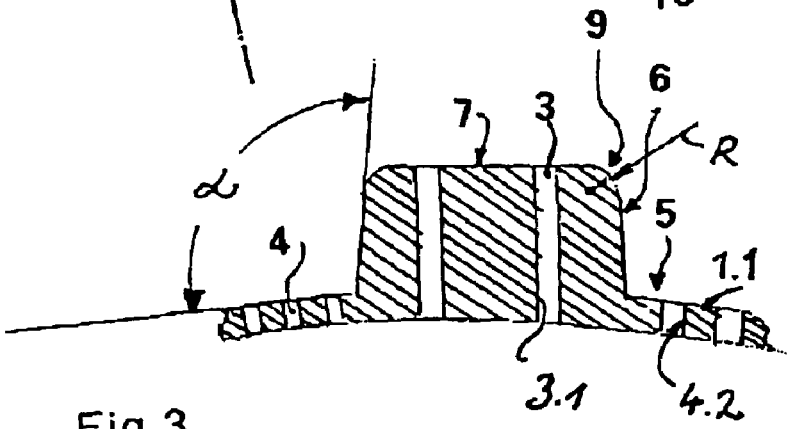
FIG. 3 shows an enlarged view of the structure element with dewatering holes.

As can be seen particularly from FIG. 3, the structure element 2 consists of a cubic or pyramidal bump or a raised formation having a flank 6 forming an angle α of between 90° and 30° or 90° and 40° or 90° and 50° or 90° and 60°, particularly between 90° and 80°, with a face 7 or 2.1 or a surface of the sieve sleeve 1.1.

As can be further seen from FIG. 3, edges 9 between the surface 2.1 or 7 and the flank 6 of the structure element 2 are rounded as indicated in the drawing in FIG. 3 by means of the radius R. In this context, it is advantageous that the transition between the lateral area 6 of the structure element 2 and the surface of the depression 5 or of the sieve sleeve 1.1 be fairly sharp-edged in order to thus create exact relief patterns on the fleece.

The structure elements 2 can have different shapes in top view designed according to the shapes to be formed in the fleece surface. The profile shape can be straight, oval or polygonal, particularly hexagonal, rectangular or triangular.

The holes 3 provided in the structure elements 2 have a width of between 0.1 and 1 mm or between 0.2 and 8 mm or between 0.4 and 0.7 mm. As can be seen particularly from FIGS. 3 to 5, the depressions 5 are also provided with a plurality of holes 4 arranged side by side. It is also possible, however, to provide two or more holes in the depressions as dewatering holes. Furthermore, the holes can be in the depressions 5 instead of in the structure elements 2.

Figure 5:
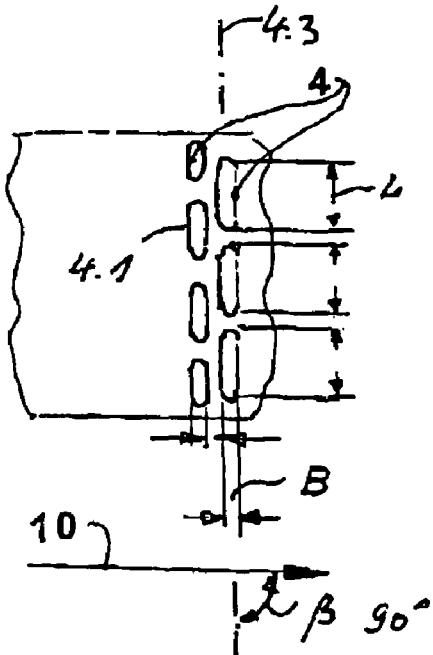
FIG. 5 shows a partial view of the drum jacket in plan view with a plurality of elongated or oval holes.
Figure 4:
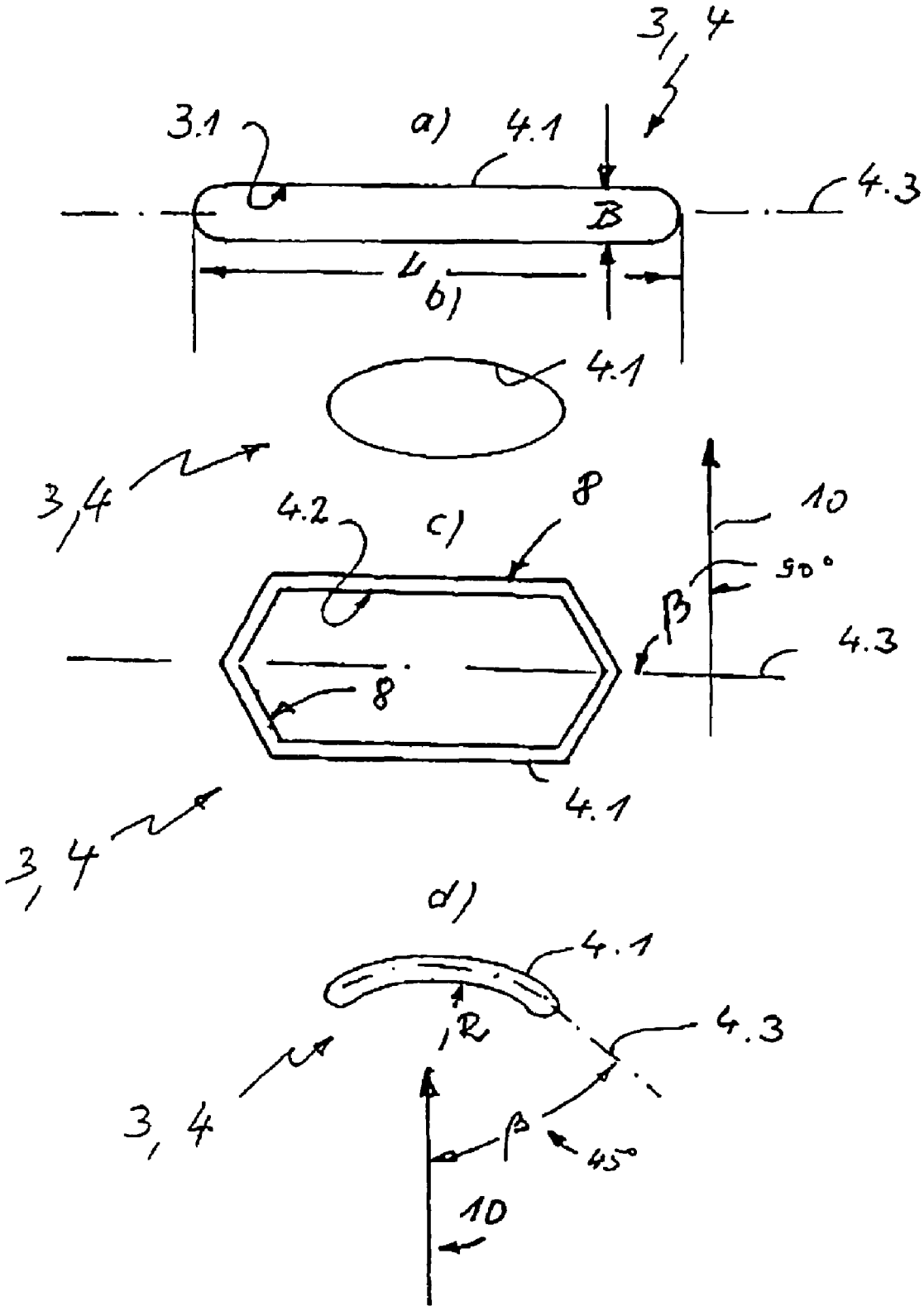
FIG. 4*a* to FIG. 4*d* show different shapes of profile holes.

The profile of the hole in the depression can either be longitudinal or oval according to FIG. 5 or polygonal according to FIG. 4, particularly hexagonal, rectangular or triangular. Thus, an optimal dewatering area in the drum jacket 1 is obtained.

The edges of the holes 4 in the depression 5 are surrounded by rims 8 of widths between 0.2 and 8 mm, preferably between 0.3 and 0.7 mm or between 0.4 and 0.6 mm.

According to FIG. 5, however, it is particularly advantageous that the elongated holes 3 and/or 4 intersect the movement plane 10 of the drum jacket 1 at an angle β of between 20° and 170° or between 40° and 160° or between 80° and 100° with their longitudinal sides 4.1. Thus, a very large surface for dewatering the drum jacket 1 is formed and damage to the fleece during the dewatering procedure is avoided.

According to FIG. 5, the elongated holes 3 and/or 4 can have a length L of between 2 and 4 mm or a width B of between 0.4 and 0.6 mm. The spacing between the elongated holes 4 can be of between 0.1 and 0.3 mm.

The holes according to FIGS. 4*a* to 4*d* can be rectangular with rounded sides, oval, polygonal or shaped like a circular arc.

The ratio of L:B (length:width)=20

The ratio of L:B (length:width)=2 to 50

The ratio of L:B (length:width)=2 to 40

The ratio of L:B (length:width)=2 to 30

The ratio of L:B (length:width)=2 to 25

The ratio of L:B (length:width)=2 to 15

The result of the dewatering is further optimized with an increase in length of the holes 3 and 4.

The structure elements or raised formations 2 provided on the drum jacket 1 in form of longitudinal raised formations can extend over the whole circumference of the drum jacket 1 in rotation direction or extend approximately diagonally to the rotation direction of the drum jacket over its whole width and form either continuous structure elements or raised formations and/or raised formations which are interrupted at some points.

The invention claimed is:

1. A drum for forming relief patterns on a surface of a textile web, the drum comprising:

a tubular jacket rotatable about an axis and having a substantially cylindrical outer surface centered on the axis and formed with an array of raised portions separated by lands and with a multiplicity of radially throughgoing holes in the raised portions, the holes being elongated and extending circumferentially at angles between 20° and 170° to midplanes extending perpendicular to the axis, the web engaging the drum;

means for directing liquid jets radially inward at the web where it engages the drum for impressing the raised portions into a face of the web; and means for aspirating liquid inward through the holes from the web where it engages the drum.

2. The drum defined in claim 1 wherein the holes are also provided in the lands.

3. The drum defined in claim 1 wherein the raised portions extend annularly completely around the drum.

4. The drum defined in claim 1 wherein the raised portions are elongated and only extending angularly partially around the drum.

5. The drum defined in claim 1 wherein the drum has axial end portions free of the raised portions.

6. The drum defined in claim 1 wherein the lands are provided with at least some of the holes and the holes in the lands make up between 12% and 80% of the overall surface area of the lands.

7. The drum defined in claim 1 wherein the holes in the raised portions extend parallel to one another.

8. The drum defined in claim 1 wherein the holes in the raised portions have widths between 0.1 mm and 1.0 mm.

9. The drum defined in claim 1 wherein the holes are also formed in the lands and have widths between 0.2 mm and 1.0 mm.

10. The drum defined in claim 1 wherein each of the raised portions has a flat radially outwardly directed face and flanks extending radially from an edge thereof to the lands.

11. The drum defined in claim 10 wherein the flanks extend at angles of at least 30° to the respective end faces.

12. The drum defined in claim 11 wherein the flanks extend of angles of at least 80° to the respective end faces.

13. The drum defined in claim 10 wherein the edges are rounded.

14. The drum defined in claim 10 wherein the flanks meet the lands at a sharp edge.

15. The drum defined in claim 1 wherein the holes have edges formed with radially outwardly projecting annular rims.

16. The drum defined in claim 15 wherein the rims have widths between 0.2 mm and 0.8 mm.

17. The drum defined in claim 1 wherein the holes have lengths between 2 mm and 4 mm and width between 0.4 mm and 0.6 mm.

18. A drum for forming relief patterns on a surface of a textile web, the drum comprising:

a tubular jacket rotatable about an axis and having a substantially cylindrical outer surface centered on the axis and formed with an array of raised portions separated by lands and with a multiplicity of radially throughgoing holes in the raised portions and in the lands, the holes being elongated and extending circumferentially at angles between 20° and 170° to midplanes extending perpendicular to the axis, the web engaging the drum;

means for directing liquid jets radially inward at the web where it engages the drum for impressing the raised portions into a face of the web; and means for aspirating liquid inward through the holes from the web where it engages the drum.

* * * * *